US006508597B2

(12) United States Patent
Freidhoff et al.

(10) Patent No.: US 6,508,597 B2
(45) Date of Patent: Jan. 21, 2003

(54) PROCESSING APPARATUS SYSTEM

(75) Inventors: Henry R. Freidhoff, Rochester, NY (US); Daniel M. Pagano, Honeoye Falls, NY (US); Joseph A. Manico, Rochester, NY (US); Ralph L. Piccinino, Jr., Rush, NY (US); Kevin H. Blakely, Rochester, NY (US); Jeffrey L. Hall, Rochester, NY (US); Todd C. Brown, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/739,418

(22) Filed: Dec. 18, 2000

(65) Prior Publication Data

US 2002/0076222 A1 Jun. 20, 2002

(51) Int. Cl.[7] ..... G03D 3/02; G03D 13/00
(52) U.S. Cl. ..... 396/565; 396/626
(58) Field of Search ..... 396/620, 622, 396/625, 626, 636, 565; 355/27.29

(56) References Cited

U.S. PATENT DOCUMENTS

| | | | | |
|---|---|---|---|---|
| 3,839,726 A | | 10/1974 | Reichardt | 396/572 |
| 5,043,756 A | * | 8/1991 | Takabayashi et al. | 396/626 |
| 5,649,261 A | | 7/1997 | Schlickhoff et al. | 396/626 |
| 5,809,362 A | * | 9/1998 | Tsuji | 396/626 |
| 5,903,795 A | * | 5/1999 | Piccinino et al. | 396/626 |
| 6,012,859 A | | 1/2000 | Boller et al. | 396/626 |
| 6,020,948 A | * | 1/2000 | Tumidei | 396/625 |
| 6,082,908 A | * | 7/2000 | Tumidei | 396/625 |

FOREIGN PATENT DOCUMENTS

| | | |
|---|---|---|
| DE | 01204729.6 | 5/2000 |
| EP | 0 623 845 | 11/1994 |
| EP | 0 703 496 | 3/1996 |

* cited by examiner

*Primary Examiner*—D Rutledge
(74) *Attorney, Agent, or Firm*—Frank Pincelli

(57) ABSTRACT

A method and processor for processing photosensitive media. The processor includes a narrow processing channel for holding a processing solution, at least one delivery opening for delivering the processing solution to the narrow processing channel, an outlet for allowing processing solution to be withdrawn from the narrow processing channel, and a recirculation system for delivering and circulating a predetermined batch amount of the processing solution through the narrow processing channel from the outlet to the at least one narrow delivery opening for processing a predetermined amount of photosensitive media passing through the narrow processing solution. The batch amount of processing solution only when media is provided in the processing channel. The processor also included an emptying system for removing the processing solution from the narrow processing channel and the recirculation system when the photosensitive media is not being processed through the narrow processing channel.

21 Claims, 12 Drawing Sheets

PROCESSING APPARATUS SYSTEM

FIELD OF THE INVENTION

Using low volume, high temperature solutions to rapidly process photographic film in a low or inconsistent utilization environment.

BACKGROUND OF THE INVENTION

Film processing cycles have been getting shorter to accommodate the demand for "one-hour" or "while you wait" film processing services. In order to shorten process cycles, solution temperatures and agitation levels are increased. These "variant processes" generally result in film images that yield inferior results when optically printed. Digital film scanners, image processing algorithms, and digital printers are used to recover acceptable image quality. Maintaining processing solutions at higher than normal or "super heated" temperatures degrades the operating life of these solutions. In addition, higher agitation in conventional processing "rack and tank" systems increases the probability for air to be imbibed by the processing solution causing oxidation. Furthermore, these "on demand" film processing situations result in inconsistent utilization of the film processor. Typically, in large solution volume processing equipment "under utilization" causes the process solutions to degrade from lack of use. Furthermore, significant energy is required to heat and maintain the temperature of the large volume of processing solutions. For some applications such as freestanding, unattended, and kiosk type film processing applications, it is desirable to use a "batch" type process to avoid the need for daily sensitometric monitoring and control associated with replenished and seasoned type processes. It is therefore desirable to provide a film processing system that prevents solution degradation due to high temperature processing, high agitation, and under utilization, and that uses significantly less energy to maintain solution temperature. This film processing system should also provide consistent processing results without the requirement of routine sensitometric monitoring and control. It is toward these ends that the present invention is directed.

In accordance with the present invention, the above described needs are satisfied by a processing apparatus and method that allows working strength processing solutions to be used at higher than normal temperatures and agitation levels. The low volume of solution in the processing apparatus allows for a small portion of the total solution volume to be "heated on demand" instead of being kept at operational temperature for long periods time. After use, the processing solutions are returned to the solution storage tank, where the heated solution is rapidly heat quenched by the larger mass of the non-heated solution in the storage tank. By using working strength, batch processing solutions the need for sensitometric monitoring and control is eliminated.

SUMMARY OF THE INVENTION

In accordance with one aspect of the present invention there is provided a processor for processing of photosensitive media, comprising:

a narrow processing channel for holding a processing solution;

at least one delivery opening for delivering the processing solution in an impinging manner against the photosensitive media to the narrow processing channel;

a recirculation system for delivering and circulating a predetermined batch amount of the processing solution through the narrow processing channel from the outlet to the at least one narrow delivery opening for processing a predetermined amount of photosensitive media passing through the narrow processing channel, the recirculation system having a conduit through which a processing solution flows and having the conduit having a heat conductive thin wall section in contact with a controlled heat source for heating of the processing solution to a first predetermined temperature; and an emptying system for removing the processing solution from the narrow processing channel and the recirculation system when the photosensitive media is not being processed through the narrow processing channel.

In accordance with another aspect of the present invention there is provided a method for processing a predetermined amount of photosensitive media in a processing apparatus having a narrow processing channel, at least one narrow delivery opening for delivering the processing solution in an impinging manner against the photosensitive media in the narrow processing channel, an outlet for allowing processing solution to be withdraw from the narrow processing channel, and a recirculation system for recirculating the processing solution through the narrow channel from the outlet to the at least one narrow delivery opening, the recirculation system having a conduit through which a processing solution flows and having the conduit having a heat conductive thin wall section in contact with a controlled heat source for heating of the processing solution to a first predetermined temperature comprising the steps of:

a. providing a predetermined batch amount of processing solution at an predetermined temperature by heating the processing solution in the conduit by the controlled heat source to the processing channel and the recirculation system;

b. maintains the predetermined amount of processing solution at an elevated predetermined temperature during processing of the photosensitive media;

c. removing the processing solution from the narrow processing channel and the recirculation system when no photosensitive media is being processed in the narrow processing channel.

In accordance with yet another aspect of the present invention there is provided a method for processing a predetermined amount of photosensitive media in a processing apparatus having a narrow processing channel, at least one narrow delivery opening for delivering processing solution in an impinging maker against the photosensitive media in the narrow processing channel, an outlet for allowing processing solution to be withdrawn from the narrow processing channel, and a recirculation system for recirculating a batch amount of through the narrow processing channel from the outlet to the at least one narrow delivery opening, the recirculation system having a conduit through which a processing solution flows and having the conduit having a heat conductive thin wall section in contact with a controlled heat source for heating of said processing solution to a first predetermined temperature comprising the steps of:

a. providing the predetermined batch amount of processing solution at an predetermined temperature by heating the processing solution in the conduit by the controlled heat source to the processing channel and the recirculation system;

b. maintains the predetermined amount of processing solution at an elevated predetermined temperature during processing of the photosensitive media;

c. cooling the predetermined amount of processing solution when no photosensitive media is being processed in the narrow processing channel.

These and other aspects, objects, features and advantages of the present invention will be more clearly understood and appreciated from a review of the following detailed description of the preferred embodiments and appended claims, and by reference to the accompanying drawings.

BRIEF DESCRIPTION OF THE DRAWINGS

In the detailed description of the preferred embodiments of the invention presented below, reference is made to the accompanying drawings in which:

FIG. 2 is a view similar to FIG. 1 illustrating a photosensitive media being transported there through;

DETAILED DESCRIPTION OF THE INVENTION

The present invention is directed to a processing apparatus and method in which a small portion of the total mass of working strength processing solution is heated on demand when imaging media is available for processing. After the imaging media is processed the solution is returned to the bulk of unheated processing solution where it is rapidly quenched and is available for use when required. The processing apparatus may be refilled with unheated solution to avoid crystals and debris forming in the apparatus from residual processing solutions. Since the processing apparatus is sealed and has a minimum of solution surface area in contact with air, unheated solution may be stored in the apparatus as well as stored in the solution storage tank. The solution in the apparatus may be re-circulated and heated without disturbing the solution in the storage tank and can be the minimum volume required to process a given size and type of imaging media.

Figure 1:
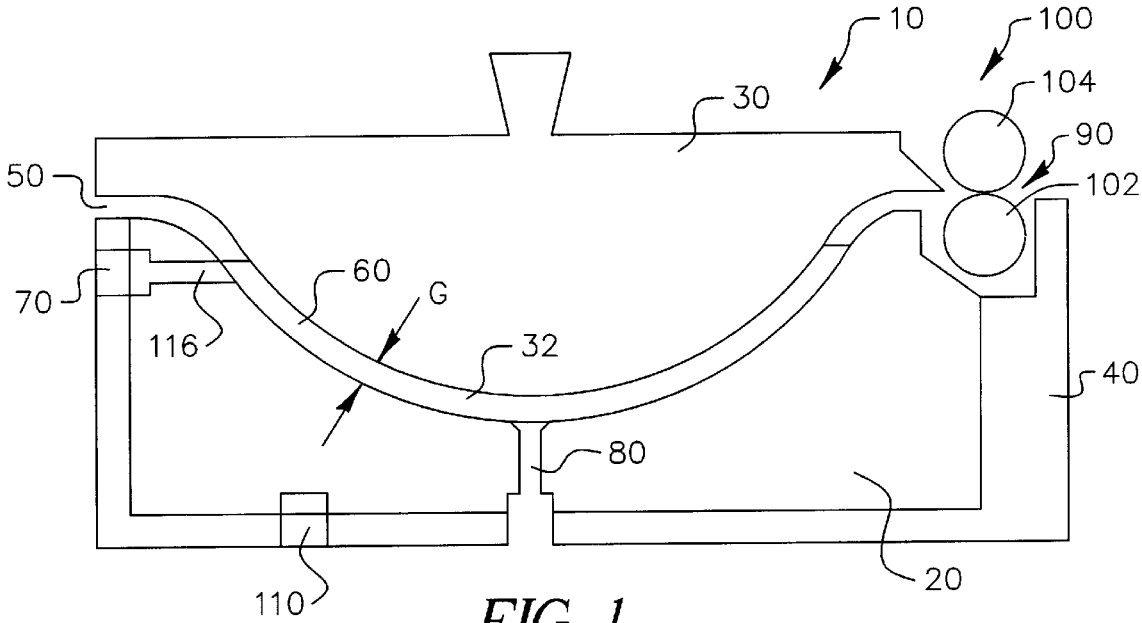
FIG. 1 is a cut away side view of a processing apparatus made in accordance with present invention.
Figure 2:
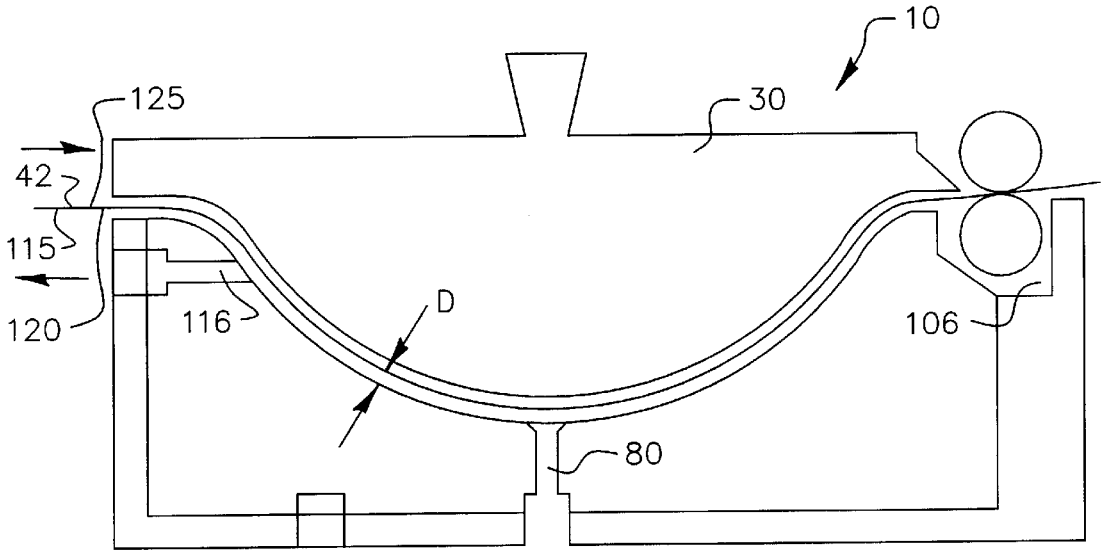
Figure 13:
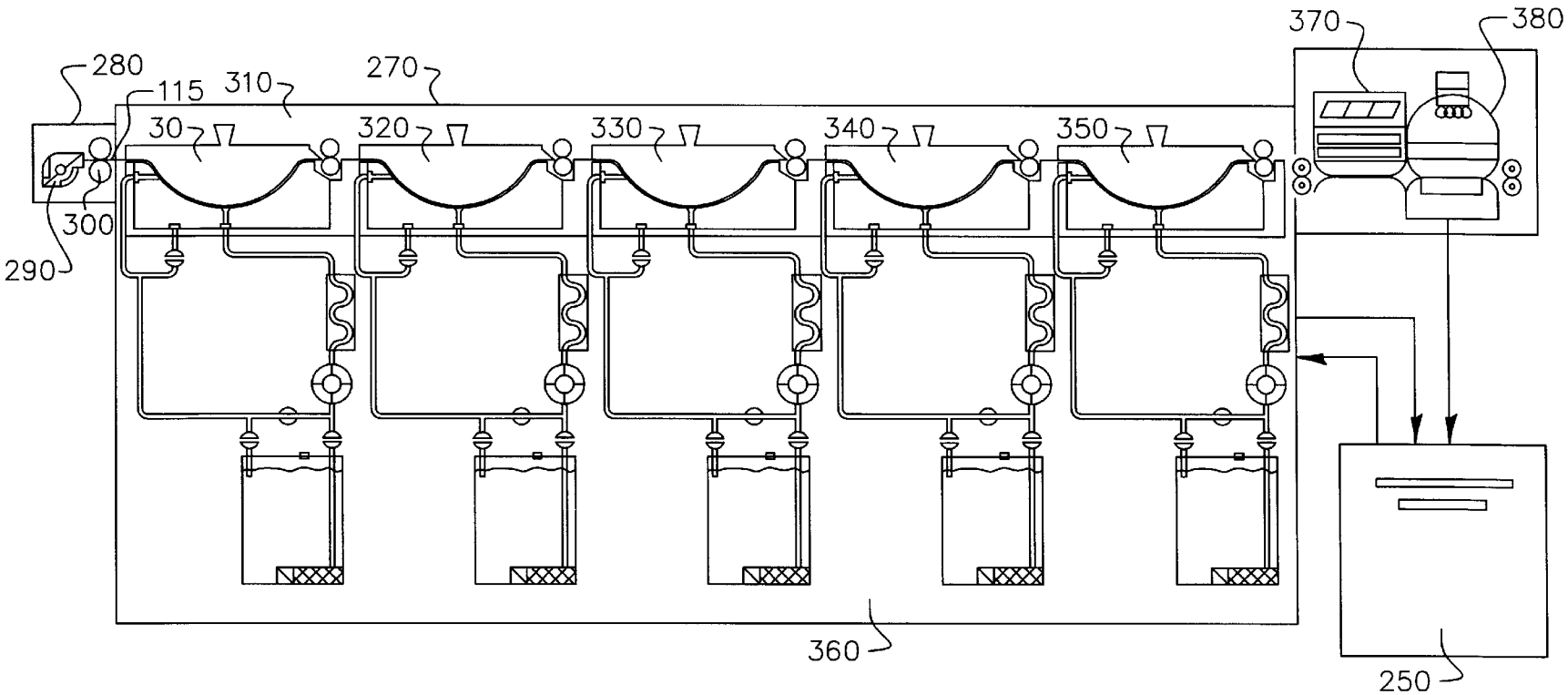
FIG. 13 is a cut away side view of a complete processing apparatus system incorporating a plurality of the processing apparatus of FIG. 3.

Referring to FIGS. 1 and 2 there is illustrated a cut away view of a processing apparatus 10 made in accordance with the present invention. The apparatus 10 includes a lower section 20 and upper section 30, both of which housed within an external tank 40. The tank is preferably insulated and made of a material, such as plastic, that does not conduct heat. Imaging media 42 (such as photographic film and/or paper) enters slot 50 into a narrow processing channel 60 formed between the lower section 20 and upper section 30. In the embodiment illustrated the sections 20, 30 are spaced by a narrow gap G so as to provide a narrow processing channel as is discussed in greater detail herein. A processing solution 32 is introduced into the processing channel 60 through a solution impingement slot 80 (see FIGS. 1 and 4) and exits the apparatus 10 through solution overflow outlet 70. While in the present invention there is illustrated only a single slot 80 and overflow outlet, any appropriate number may be provided. The size of the slot 80 is preferably selected so that the solution 32 will be impinged against the media 42 so as to provide fresh processing solution 32 against the emulsion layers typically provided on the media 42. The imaging media 42 moves through channel 60 to the integrated transport/solution squeegee roller set 100 where residual solution is removed from the media 42 and the media 42 is transported to the next stage of the process (for example as shown by FIG. 13).

Imaging media 42 has an emulsion side 120 positioned toward solution impingement slot nozzle 80 and back side 125 biased against upper section 30 to establish a fixed gap having a width D between the emulsion surface 120 and the slot nozzle 80. This is done to achieve consistent agitation and development over the length and width of the imaging media.

Figure 3:
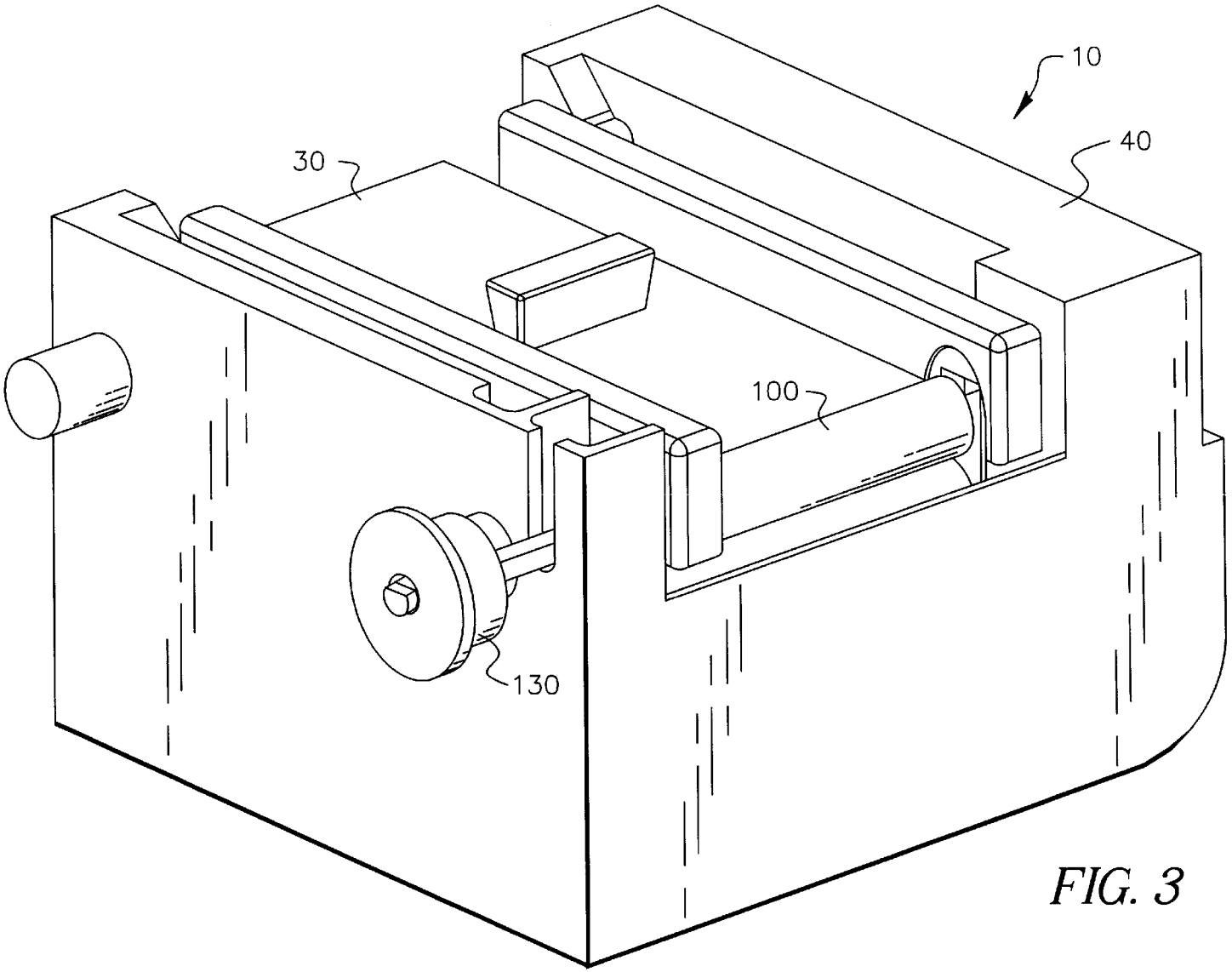
FIG. 3 is a perspective view of the processing apparatus of FIG. 1.

Apparatus 10 includes transport/solution squeegee assembly 100 which comprises a pair of contacting roller 102, 104 with drive gear 130 (as can best be seen by reference to FIG. 3). Processing solution is removed from the imaging media 42 and is collected in a collection section 106 provided external tank 40. This excess may be recirculated as later discussed or simply discarded.

Figure 4:
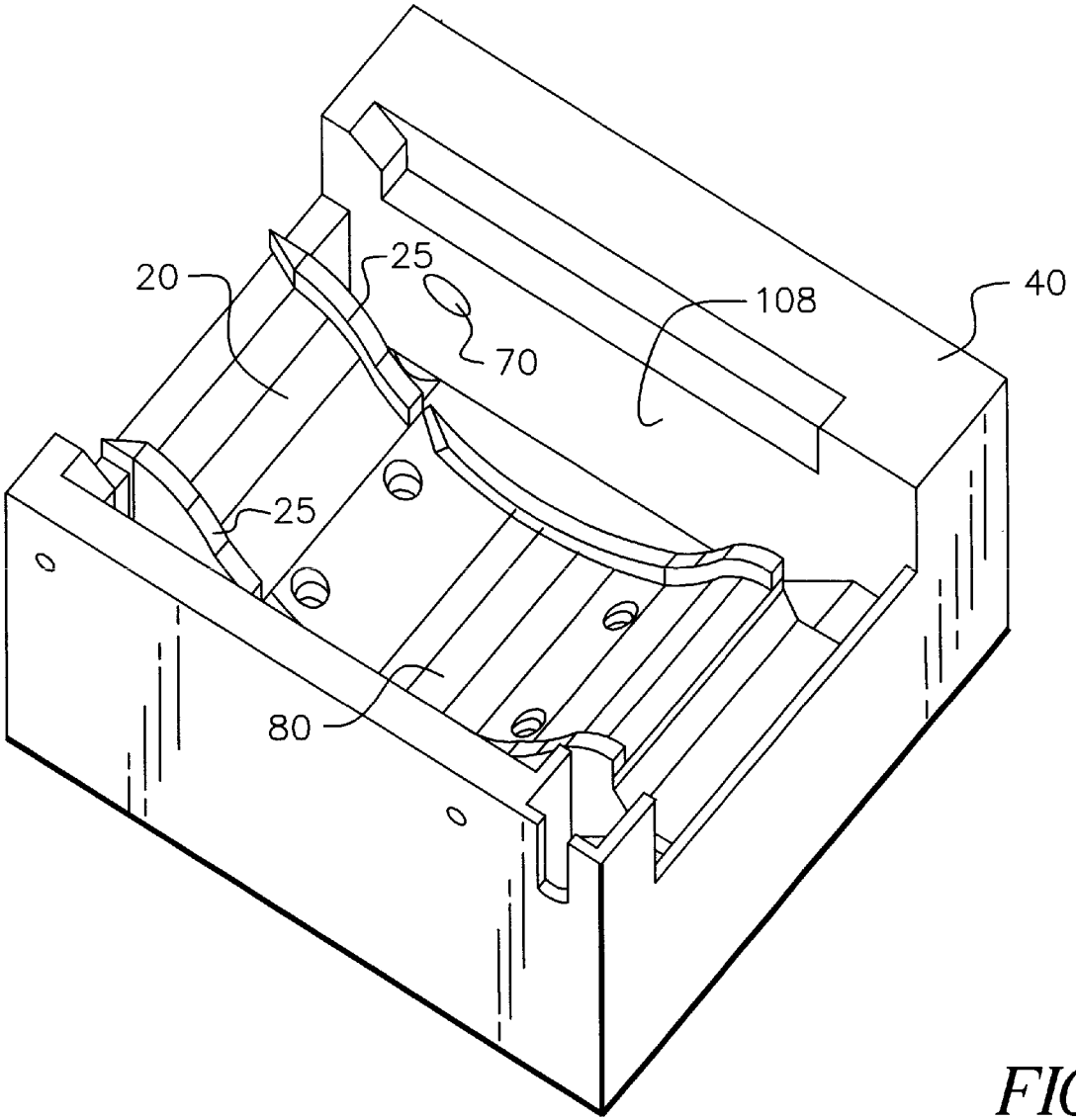
FIG. 4 is a perspective view of the lower processing and tank section of the apparatus of FIG. 3.

FIG. 4 is a perspective view of the lower processing section 20 and tank section 40 with the upper section 30 has been removed. Solution impingement slot nozzle 80 is visible at the center of lower section 20 and solution overflow outlet 70 can be seen on the side wall 108 of external tank 40. The system is shown with one slot nozzle 80 but multiple slot nozzles may be used as previously discussed. Conduits 116 in external tank 40 (see FIGS. 1–12) channel the overflow solution out of the process apparatus 10. External tank 40 is used to collect process solution that flows out of the processing channel 60. The processing channel 60 is formed when lower processor section 20 is fitted to upper processor section 30 (see FIG. 5) with support projection 25 fitted to mating section 35 (see FIG. 5). The combination of support projection 25 and mating section 35 establishes a precise gap G between upper section 30 and lower section 20. The gap G is designed so as to provide a relatively narrow processing channel 60 through which the media passes. Typically the gap G is no greater than about 0.25 inch, preferably no greater than about 0.125 inches. Applicants have found that a gap G of about 0.1 inches is best for a typical photographic paper.

U.S. Pat. Nos. 5,319,410; 5,353,083; 5,389,994; 5,270,762; 5,355,190; 5,398,094; 5,432,481; 5,418,592 illustrate examples of processors having a narrow processing channel which are hereby incorporated herein by reference. Preferably, the gap G is selected so as to minimize the amount of solution 32 available for processing of the media 42. Thus the gap G is selected so as to be sufficiently large so as to allow the media 42 to easily pass through the channel 60, but not too large that a large amount of processing solution is needed for filling of the channel. In the embodiment illustrated the amount of solution that is to be circulated during processing is preferably equal to or slightly more than necessary for developing of a predetermined amount of media to be processed in a batch. Preferably an amount of processing solution equal to or greater than about 125% of the processing solution need for processing of the batch of media to be processed and most preferably between 150% to 200%.

Figure 5:
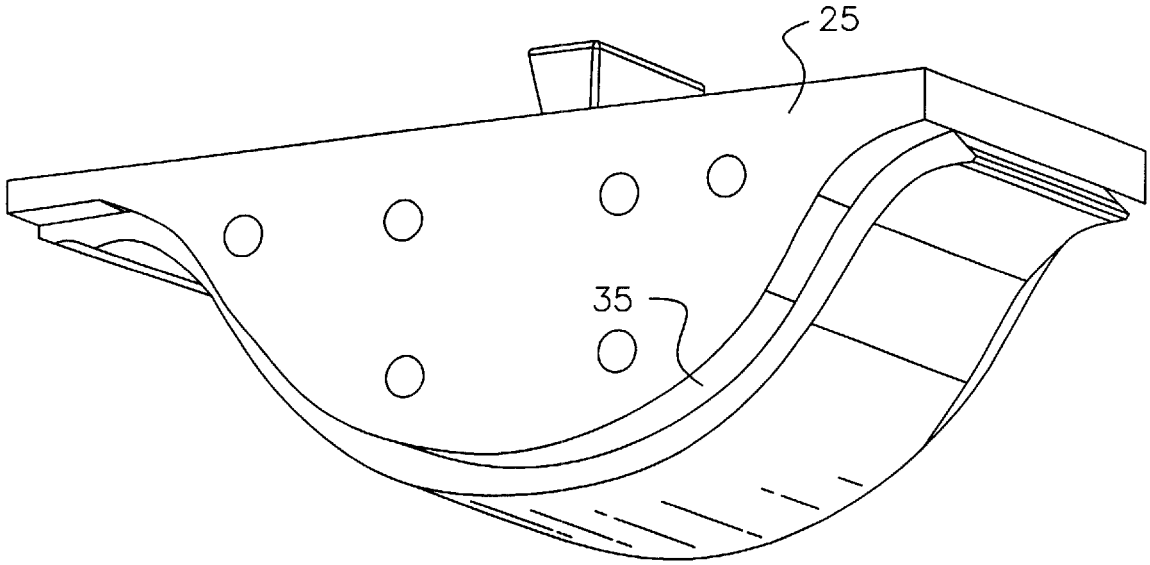
FIG. 5 is a perspective view of the upper section that forms the upper portion of the processing channel of FIG. 3.

FIG. 5 illustrates a perspective view of upper processing section 30 illustrating the curved shape of the process apparatus which forms the upper surface of processing channel 60.

Figure 6:
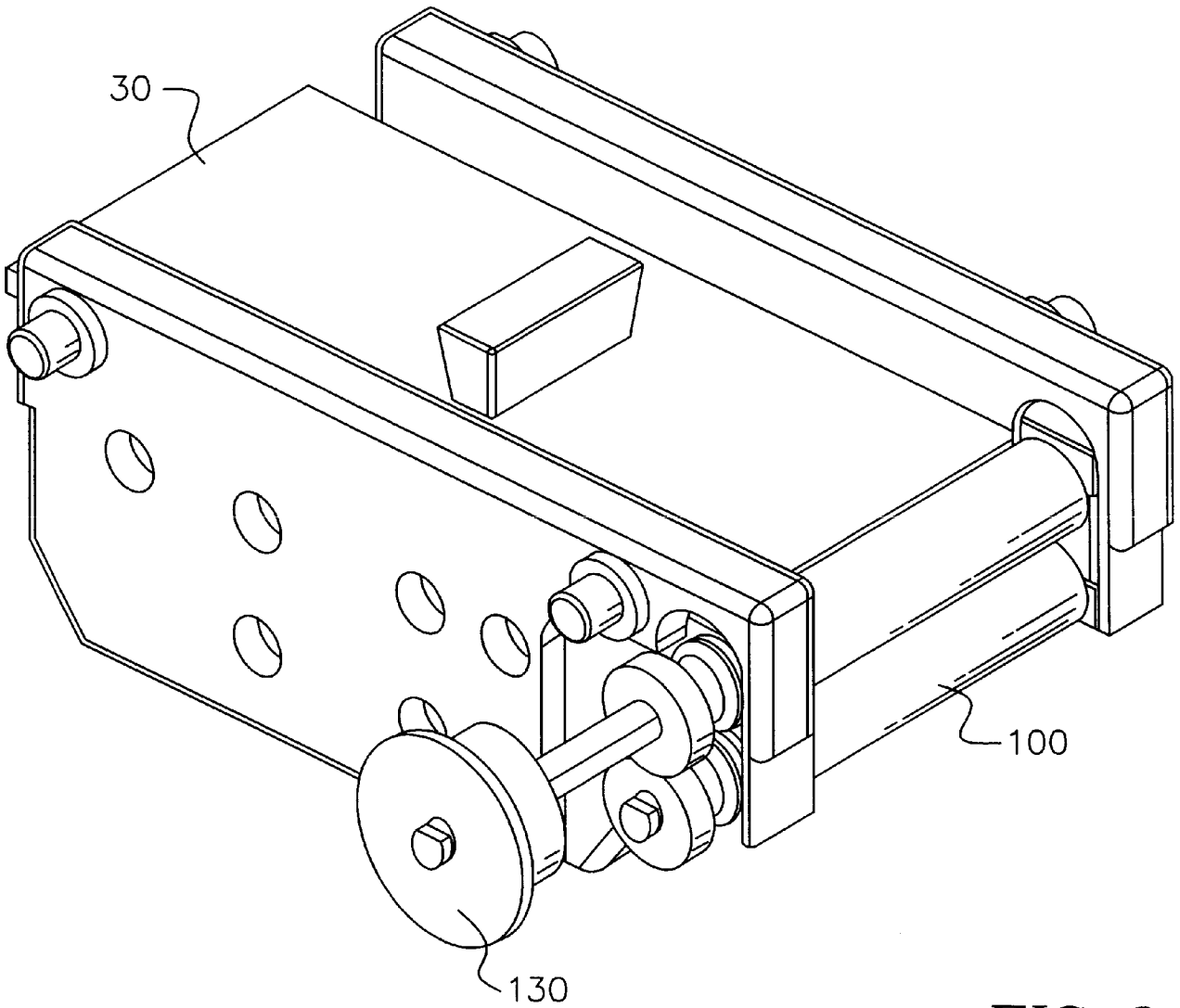
FIG. 6 is a perspective view of the upper section the and attached transport assembly.

FIG. 6 illustrates a perspective view of upper processing section 30 with transport/solution squeegee roller set 100 and drive gear 130.

Figure 7:
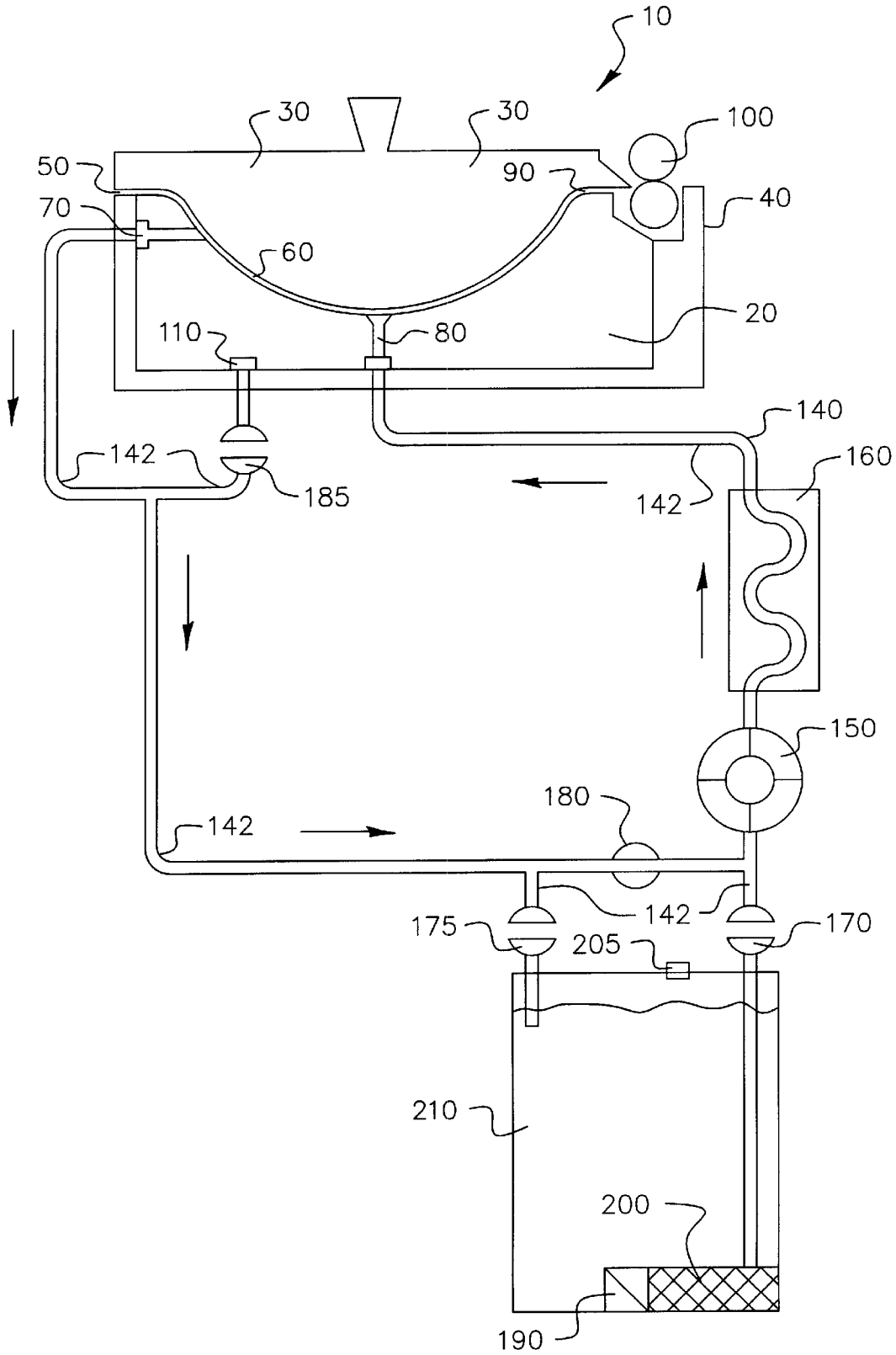
FIG. 7 is a schematic diagram of the apparatus of FIG. 3 illustrating the batch solution management system operating in the "NORMAL OPERATION" mode.

FIG. 7 is a schematic diagram of process apparatus 10 and batch solution management system 140 for introducing and recirculating processing solution 32 a predetermined amount of processing solution 32 through the processing channel 60 when media is to be processed in channel 60. FIG. 7 illustrates the solution management system 140 in the "NORMAL OPERATION" mode for processing of media in the processing channel 60. The batch solution management system 140 includes appropriate conduits 142 and the following components solenoid controlled valves 170, 175, 180, and 185, pump 150, an on demand heater 160 and solution storage tank 210. The conduits and various other components of system 140 are preferably made of a material, such as plastic, that does not conduct heat. Within solution storage tank 210 a filter 200 is provided which filters solution being withdrawn from the storage tank 210, and flapper valve 190 is provided which opens when solution flows back into the tank 210 via gravity. Pressure relief valve 205 allows any build up of gas, due to solution flow in and out of storage tank 210 to be automatically vented. Unheated, working strength, processing solution 32 is stored in solution storage tank 210. The processing apparatus 10 has been filled with processing solution 32 by drain through pump 150 through on-demand heater 160. On-demand heater 160 is of the type that is used to heat liquids rapidly when the heated liquid is needed, as opposed to the type that maintains a volume of liquid at a required temperature for long periods of time. This is accomplished by passing liquid through a length of thin walled heat conducting tubing in contact with a controlled heat source. The processing solution is extracted from storage tank 210 through filter 200 and solenoid controlled valve 170 flapper valve 190 is automatically closed by the suction generated by pump 150. The solenoid controlled valves 170, 175, 180, and 185 are individually and automatic set opened or closed by control computer 250 depending on the desired mode of operation. Processing solution 32 enters processing apparatus 10 via impingement slot nozzle 80, via solution delivery system 140. Supply 170 and return 175 solenoid controlled solution valves are closed. Crossover solution control valve 180 is opened and processing apparatus solution drain solenoid controlled solution valve 185 is closed. At this point the system is prepared for "NORMAL OPERATION" mode. The process apparatus 10 and solution management system 140 are filled with processing solution which is being heated to a set temperature by on demand heater 160 and re-circulated by pump 150. Heated process solution contacts the film emulsion (not shown) via slot nozzle 80 and exits the apparatus through overflow 70. When storage solution return solenoid controlled valve 175 is closed this prevent solution from being returned to the storage tank 210 and when storage solution crossover solenoid controlled solution valve 180 is opened and storage solution supply solenoid controlled solution valve 170 is closed. This allows the solution to bypass the solution storage tank 210 and to be re-circulated by pump 150 and through on demand heater 160, through slot nozzle 80, back into processing apparatus 10. Computer 250 in addition for controlling the valves is also used for overall control, operation and monitoring the apparatus including the pump, heater, sensors, display lights, user interface, etc associated with the apparatus 10.

Figure 8:
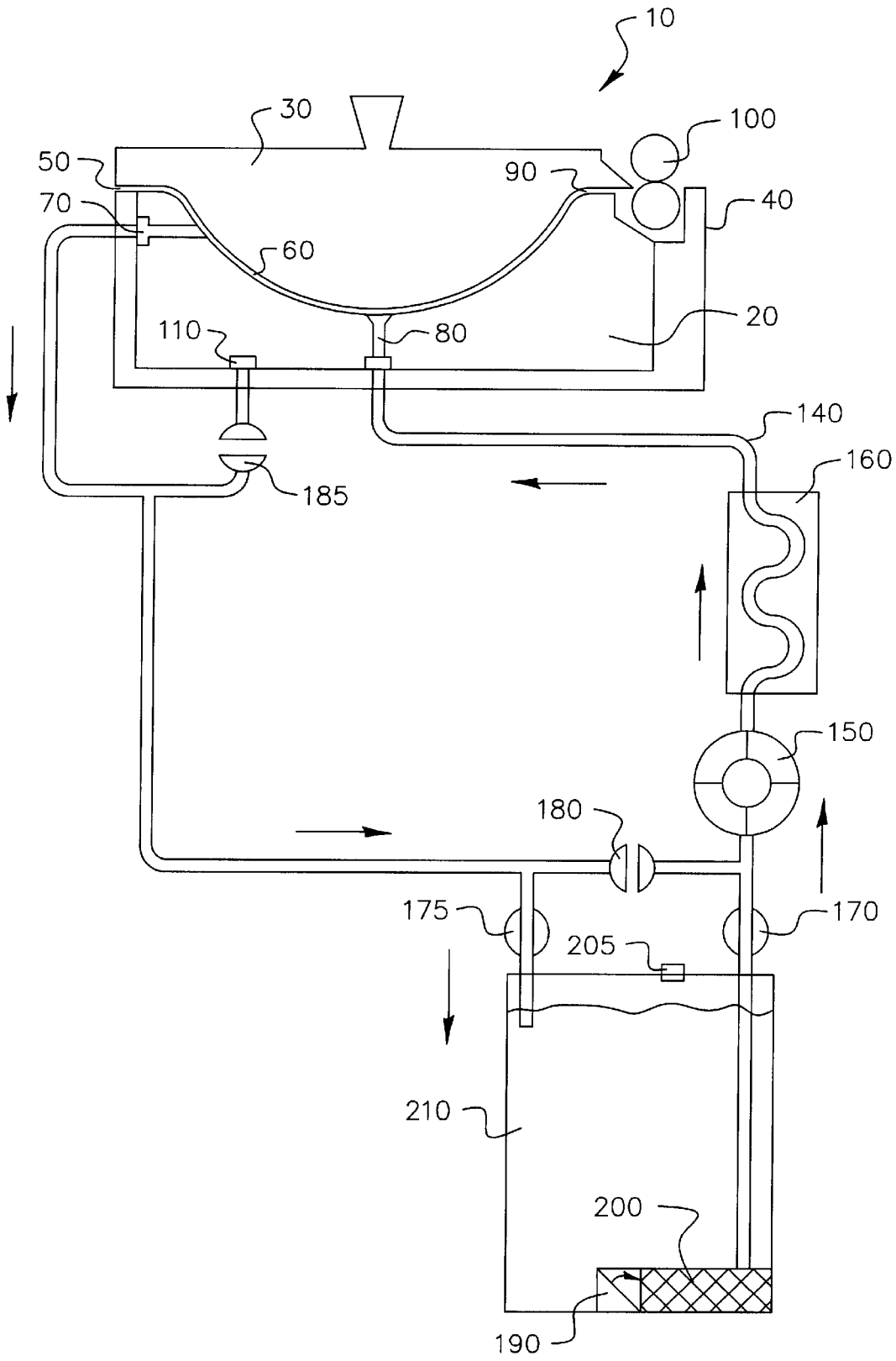
FIG. 8 is a schematic diagram of the apparatus shown of FIG. 3 illustrating the batch solution management system operating in the "REFRESH/FILL OPERATION" mode.

FIG. 8 is a cut away side view illustration of a process apparatus and batch solution management system 140 in the "REFRESH/FILL OPERATION" mode. This mode is used to fill or exchange the working strength processing solution in process apparatus 10. Supply 170 and return 175 solenoid controlled solution valves are opened, crossover solution control valve 180 is closed, and apparatus solution drain solenoid controlled solution valve 185 is closed. Flapper valve 190 is automatically closed by the suction caused by pump 150 forcing process solution to flow through filter 200. Filter 200 may be of any well known type and construction that filters out physical debris and/or may be used to treat the working strength processing solution with ion exchange resins or activated charcoal. The solution proceeds through on-demand heater 160 through solution delivery system 140. The on-demand heater 160 may or may not be used to heat the solution at this time depending on the amount of solution or time used to refresh processing apparatus 10 so as not to heat the mass of solution in the storage tank. The solution will be heated, regardless, during the "Normal Operation" cycle. The solution enters the process apparatus 10 via impingement slot nozzle 80, filling processing apparatus channel 60, and exits through overflow 70. Once apparatus 10 has been "REFRESHED or FILLED" it can then remain idle, waiting for the next section of imaging media to process. It is switched over to "NORMAL OPERATION" when solenoid controlled valves supply 170 and return 175 are closed and crossover 180 is opened.

Figure 9:
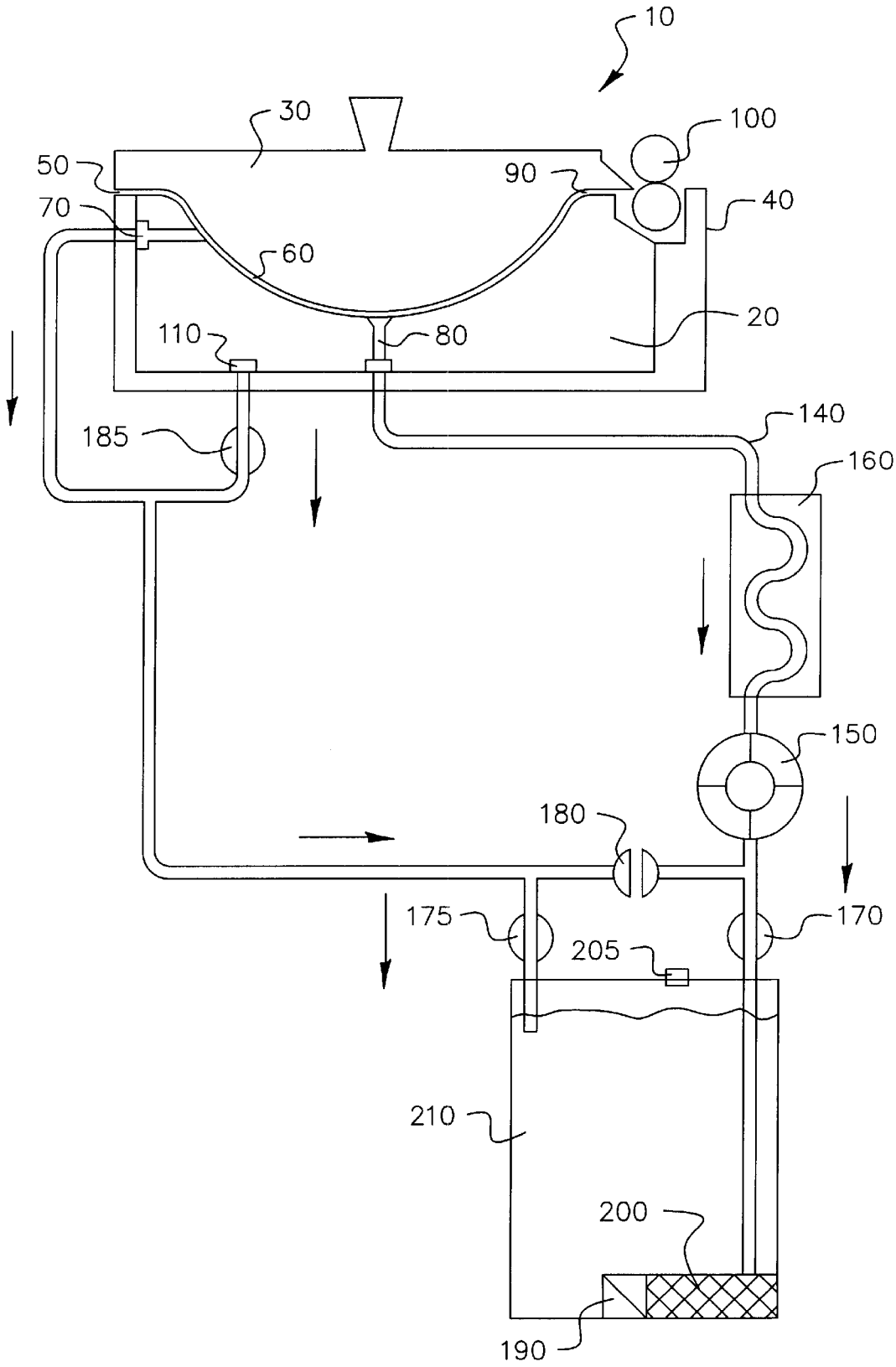
FIG. 9 is a schematic diagram of the apparatus shown of FIG. 3 illustrating the batch solution management system operating in the "DRAIN OPERATION" mode.

FIG. 9 is a cut away side view illustration of a process apparatus 10 and batch solution management system 140 in the "DRAIN OPERATION" mode. This mode is used to remove the process solution from the processing apparatus 10. Supply 170 and return 175 solenoid controlled solution valves are opened, crossover solution control valve 180 is closed, and apparatus solution drain solenoid controlled solution valve 185 is opened. The lack of pressure from pump 150 causes flapper valve 190 to open allowing for processing solution to drain from apparatus 10 through impingement slot nozzle 80, through pump 150 which has been turned off. The tank 210 is position such that the solutions drain back into storage tank 210 via gravity. Valve 205 allows excess air to escape tank 210 as it is being filled with solution 32.

In order to better understand the present invention a description of its operation will be discussed. Initially the apparatus 10 is in the non operational state as illustrated by FIG. 9. Typically a predetermined amount of media, for example a roll of photographic film, is designated for passing through the apparatus 10. Prior to the media 42 entering the processing channel, the processing channel 60 and management system 140 is fill with processing solution obtained from tank 210 as show and discussed with respect to FIG. 8. That is valves 170 and 175 are opened, valves 180 and 185 are closed, and pump 150 is activated by computer 172 so as to fill the channel 60 and system 140. Once filled, valves 170 and 175 are closed and valve 180 is opened. This allows a batch amount of processing solution to be recirculated through the channel and system 140 as shown by FIG. 7. Heater 160 is activated so as to heat the circulating batch of processing solution 32. Since the amount of processing solution 32 in channel and system is small, the batch processing solution can be quickly heated to an elevated temperature higher than normally expected. For example in the present invention the batch amount of processing solution 32 is heated to a temperature in the range of 115° F. to 130° F. The media is transported through channel 60 where the processing solution 32 acts on the media 42. In the embodiment illustrated the media 42 is roll of photographic film having 36 exposures and the batch amount of processing solution provided in channel 60 and system 140 is about 30 ml and the tank 210 is designed to hold about 3 liters of processing solution. This provides a ratio of solution in the tank 210 to the batch of processing solution of about 100 to one, however this ratio may vary depending of the temperature difference between the batch of solution and the solution in the tank 210, the designed rate of use of the processing solution, and the cooling rate of the tank. Generally the ratio of the processing solution in the tank 210 to the batch of processing solution is preferably greater than about 50 to one. Once the media 42 has passed through channel 60, the batch solution is drained from channel 60 and system 140 as illustrated by FIG. 9. In particular, valves 170, 175, and 185 are opened and pump 150 is turned off. This allows the batch of processing solution to drain into tank 210 where it mixes with solution 32 contained therein. A sufficient amount of processing solution remains in tank 210 during processing of the media such that when the batch of solution returns to tank 210, the working batch will be quenched to about ambient temperature (about 72°) or what ever temperature the solution in tank 210 is maintained. This minimizes the amount of time in which the batch solution is maintained at the elevated temperature. This avoids or minimizes any possible degradation of the processing solution 32 being at the elevated temperature. This process is repeated each time batch of media that is introduced into apparatus 10 processing. The batch of processing solution is provided sufficient so that the amount of media passing through channel 60 will be fully developed. The computer 250 keeps track of the amount media that is processed by the total volume of processing solution available from tank 210. When it is determined that the quantity of processing solution 32 has been chemically exhausted, the computer will provide the appropriated notice to the operator that the solution 32 needs replacement and/or replenishment.

Figure 10:
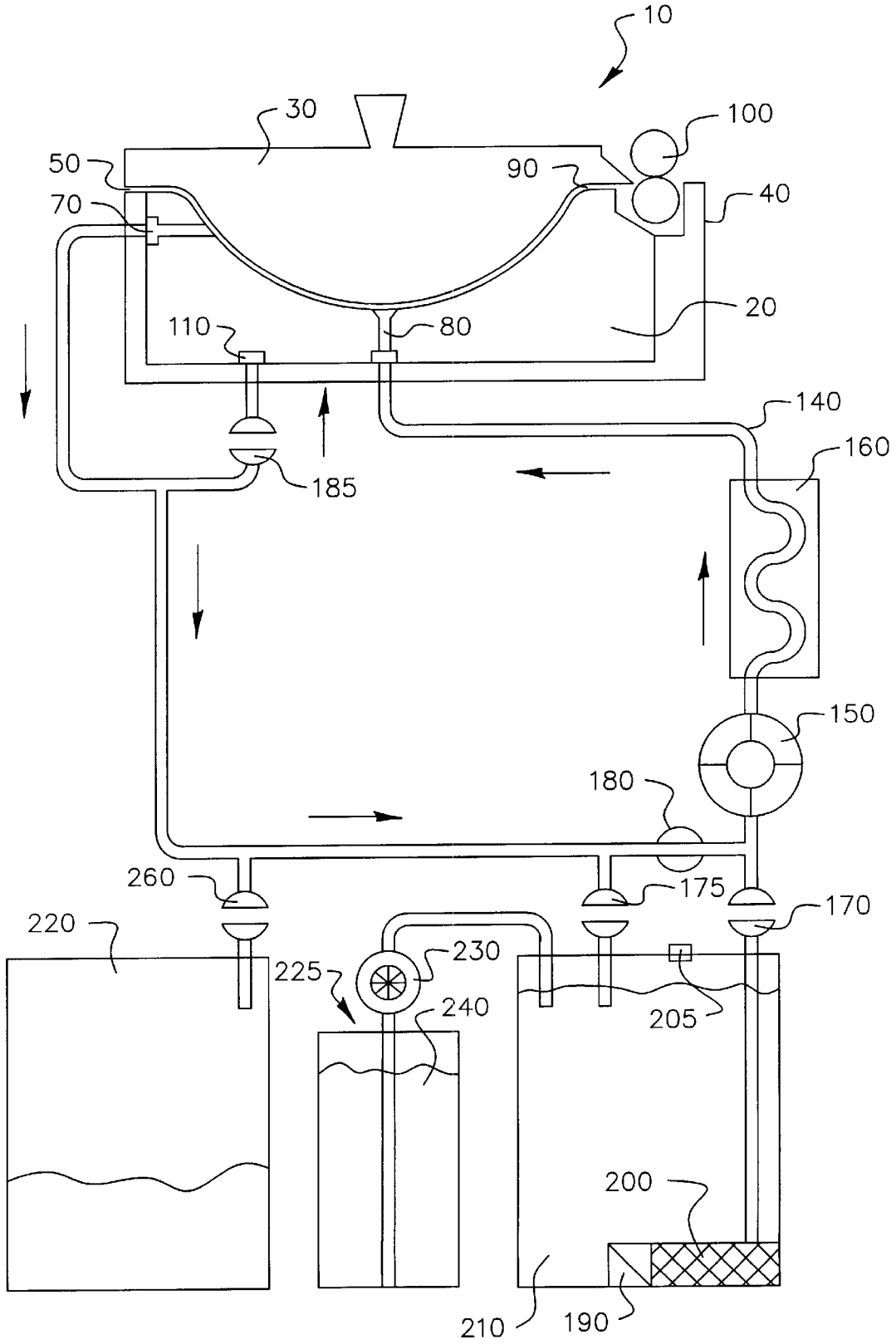
FIG. 10 is a schematic diagram of the apparatus of FIG. 3 illustrating the batch solution management system incorporating a solution replenisher module and effluent collection tank in the "NORMAL OPERATION" mode.

FIG. 10 is a schematic illustration of modified processing apparatus 10 and solution management system 240 incorporating a working solution batch replenisher module 225 and effluent collection tank 220 in the "NORMAL OPERATION" mode. Management system 240 is similar to system 140 like numerals representing like parts and operation. A replenisher storage tank 240 and solution metering pump 230 have been for allowing a precise amount of replenishment solution 242 to the solution storage tank 210 based on the amount of imaging media 42 that has been processed in channel 60. Replenisher 242 can be added to the solution storage tank 210 at any convenient point before, after, or during "Normal Operation". The processing apparatus 10 has been filled with processing solution by drain through pump 150 through on-demand heater 160. The processing solution 32 is extracted from storage tank 210 through solenoid controlled valve 170. Processing solution 32 enters processing apparatus 10 via impingement slot nozzle 80, via solution delivery system 140. Supply 170 and return 175 solenoid controlled solution valves are closed. Crossover solution control valve 180 is opened and processing apparatus solution drain solenoid controlled solution valve 185 is closed. Heated process solution contacts the emulsion (not shown) on media 42 and exits the apparatus through overflow 70. Storage solution return solenoid controlled valve 175 is closed preventing the solution from being returned to the storage tank 210 and storage solution crossover solenoid controlled solution valve 180 is opened and storage solution supply solenoid controlled solution valve 170 is closed. This allows the solution to bypass the solution storage tank 210 and to be re-circulated by pump 150 and through on demand heater 160, through slot nozzle 80, back into processing apparatus 10. Solenoid controlled solution valve 260 is closed preventing re-circulating solution from entering the effluent storage tank 220.

After the imaging media has been processed, the process apparatus 10 can be either drained into effluent tank 220 through valve 260 or returned to the solution storage tank 210.

It is well know in the art to use film speed, format, and length, provided by the various film information system such as DFX coding, bar-coding, or magnetics on film (MOF), to inform the processor and scanner of the media type and format to be processed and scanned. Also it is known to use electronic and digital image information available from the existing electronic scanning sensing means to analyze the color and density of the images on the imaging media to determine the level of use of the processing solution. Replenisher 240 is used to either maintain process activity as the batch is used to extend the total amount of imaging media that can be processed by a batch of solution. Unlike typical "replenished systems" where "seasoned" solutions are continually replenished and monitored for extended periods of time, the entire batch is replaced with a fresh batch of solution once the maximum amount of image media has been processed. Sensitometric data to determine the amount of process solution usage can be obtained via analysis of the image data obtained from the digital scanner 380 (see FIG. 13). Color, density, and/or physical measurements can be used to obtain sensitometric solution usage data.

Figure 11:
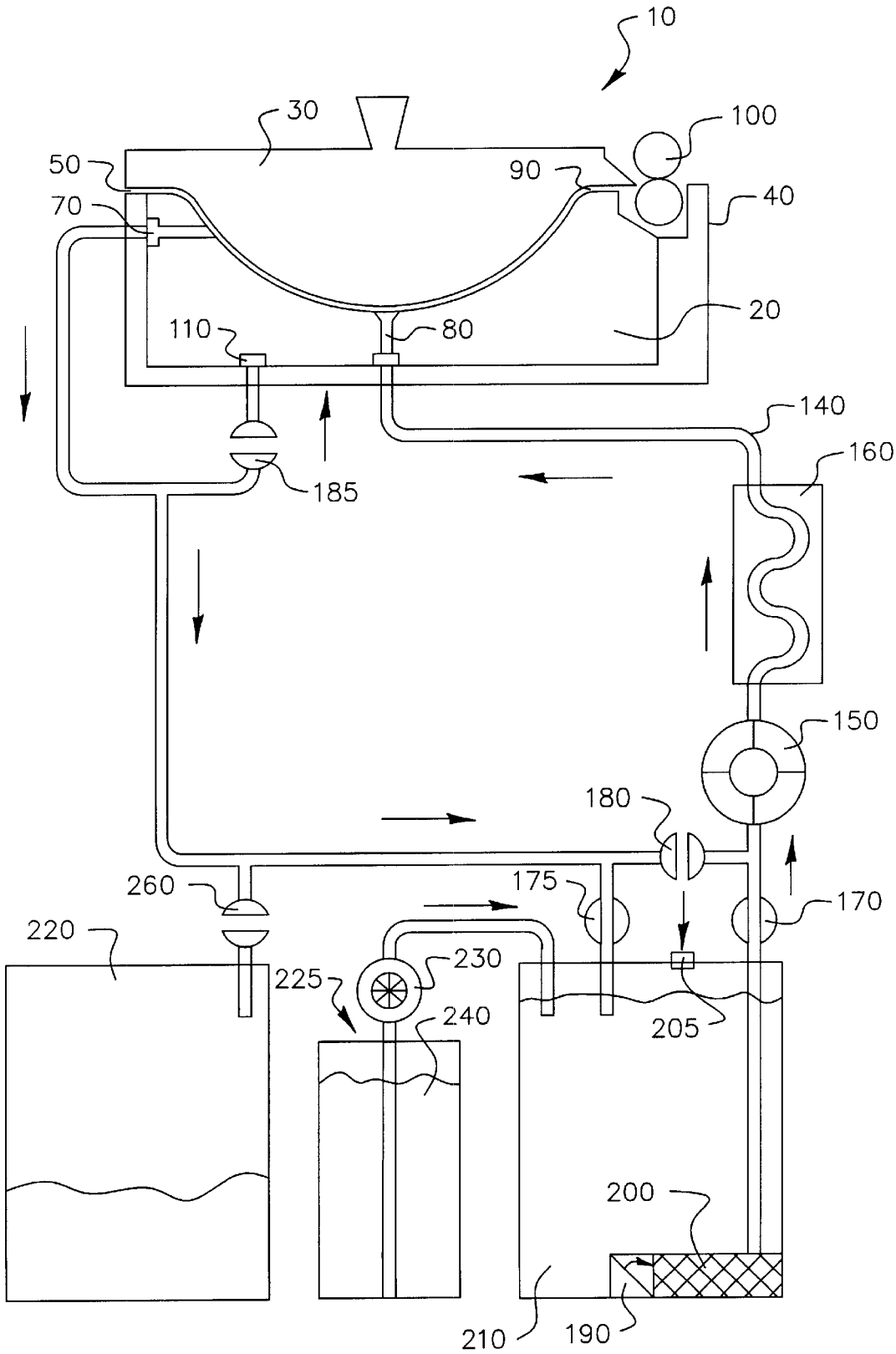
FIG. 11 is a schematic diagram of the apparatus of FIG. 3 illustrating the batch solution management system incorporating a solution replenisher module and effluent collection tank in the "REFRESH OPERATION" mode.

FIG. 11 is a cut away side view illustration of a processing apparatus 10 and solution management system 240 incorporating a solution replenisher module 225 and effluent collection tank 220 in the "REFRESH OPERATION" mode. This mode is used to fill or exchange the working strength processing solution in process apparatus 10. Supply 170 and return 175 solenoid controlled solution valves are opened, crossover solution control valve 180 is closed, and apparatus solution drain solenoid controlled solution valve 185 and 260 are closed. At this point replenisher module 225 may be activated to deliver a metered amount of replenisher solution via solution metering pump 230 to solution storage tank 210. When complete, pump 150 activates and flapper valve 190 is automatically closed by the suction produced by pump 150 forcing the process solution to pass through filter 200. The solution proceeds through on-demand heater 160 through solution delivery system 140. The on-demand heater 160 may or may not be used to heat the solution at this time depending on the amount of solution or time used to refresh processing apparatus 10 so as not to heat the mass of solution in the storage tank. The solution will be heated, regardless, during the "Normal Operation" cycle. The solution enters the process apparatus 10 via impingement slot nozzle 80, filling processing apparatus channel 60, and exits through overflow 70. Several re-circulation cycles may be repeated in order insure that the working strength solution and replenisher are adequately mixed. Once apparatus 10 has been "REFRESHED or FILLED" it can then remain idle, waiting for the next section of imaging media to process. It is switched over to "NORMAL OPERATION" solenoid controlled valves supply 170 and return 175 are closed and crossover 180 is opened.

Figure 12:
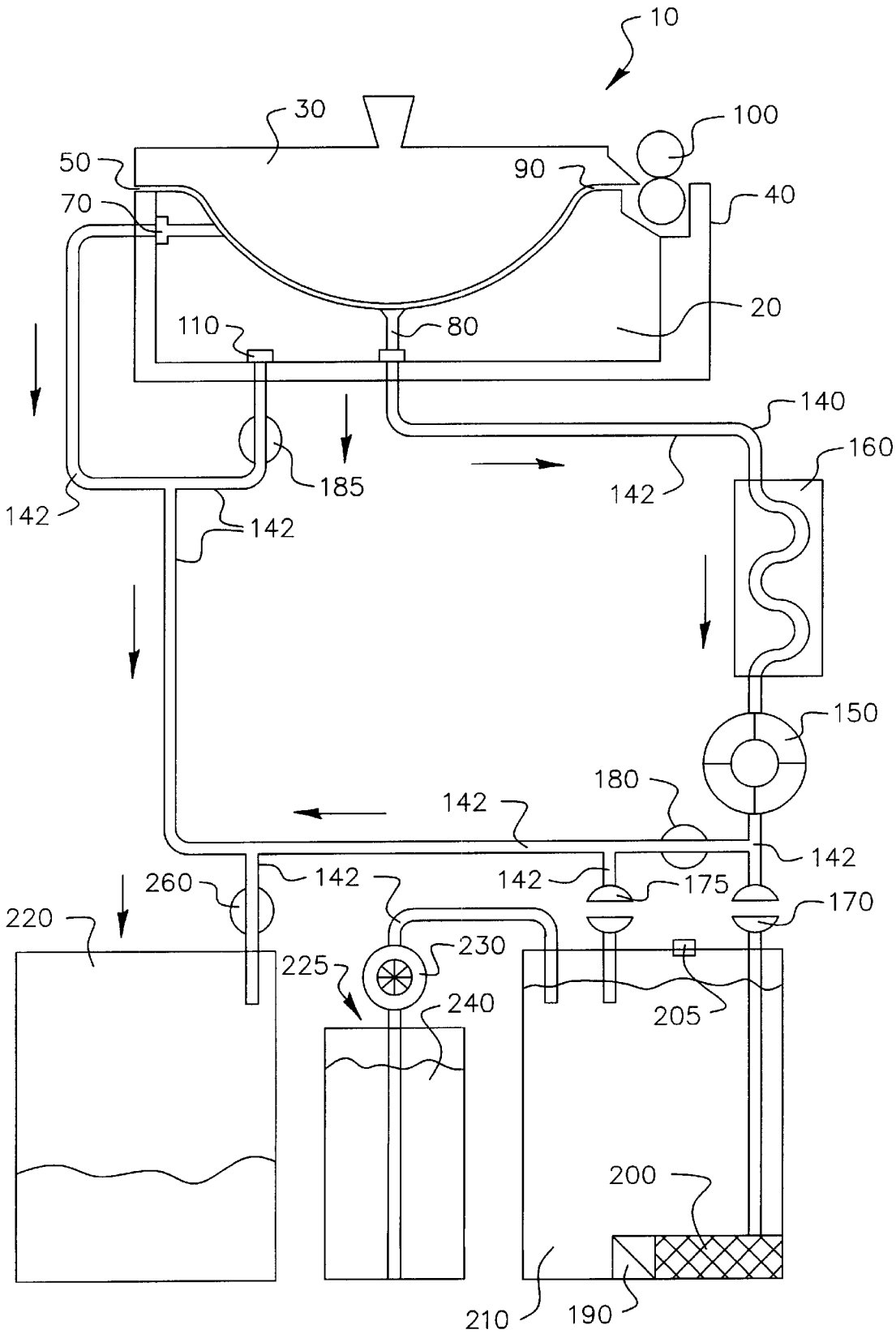
FIG. 12 is a schematic diagram of the apparatus of FIG. 3 illustrating the batch solution management system incorporating a solution replenisher module and effluent collection tank in the "DRAIN OPERATION" mode.

FIG. 12 a cut away side view of a process apparatus and solution management system incorporating a solution replenisher module and effluent collection tank in the "DRAIN OPERATION" mode. This mode is used to remove the process solution from the process apparatus. Supply 170 and return 175 solenoid controlled solution valves are closed, crossover solution control valve 180 is opened, and apparatus solution drain solenoid controlled solution valve 185 is opened. The lack of pressure from pump 150 process solution 32 to drain from apparatus 10 through impingement slot nozzle 80, through pump 150 which has been turned off. The effluent tank solution return solenoid controlled solution valve 260 is opened to allow solution to drain back into effluent tank 220 via gravity.

The operation of the modified apparatus and system 240 operates much in the same manner as the embodiment of FIGS. 7–10 except that the apparatus can be operated for longer periods of time. As previously noted only a relatively small batch of processing solution is used for processing of the batch amounts of media being passed through the processor and then returned to tank 210. By properly monitoring the amount of media that is processed by a single batch of processing solution, the apparatus can be operated in the continuos operational mode. When the batch of processing is chemically depleted, it is sent to effluent tank 220 and fresh solution from tank is introduced into system 240. This can be done as the old batch is being emptied into tank 220 or just after. For example by closing valve 18, opening valves 170, 260 and by running pump 150 fresh solution is being supplied to system 240 while the exhausted batch solution leaves system 240. The valves are maintained in this state until a sufficient an appropriate period of time and then valves 260, 270 are closed while valve 180 is opened for returning the system to a batch operation.

An apparatus made in accordance with the present invention has numerous advantages. For example, due to the low amount of processing solution in a batch, it can be rapidly heated to high than normal temperatures and cooled when it is returned to the tank 210. The non-heating conducting materials used and insulated tank also assists in providing an efficient heating system. Also a single pump is used for filling of the system and circulating of the processing solution.

Referring to FIG. 13 there is illustrated a schematic illustration of a complete integrated processing apparatus system 270 with imaging media loading station 280 which is used to extract imaging media 115 from the light tight cartridge 290 for the purposes of illustration is an APS film cartridge. Controlled drag loading rollers 300 are used to meter imaging media into the first Processing apparatus/solution management module 310. Rollers 300 are slightly slower that subsequent media drive rollers in the system to assure that the back side 125 of the imaging media 115 is pulled against upper section 30. To prevent scuffing and damage to the imaging media controlled drag loading rollers are attached to the drive system by means of a slip clutch (not shown). The number of processing apparatus/solution management modules may be any number from 1 to n depending the process requirement for a given imaging media. For the purposes of illustration the process cycle for process step 1, 310 is Developer, for step 2, 320 is Bleach, for step 3, 330 is fixer, for step 4, 340 is Rinse, and for step 5, 350 is Stabilizer. All of the modules 310 through 350 are contained within processor section outer encasement/housing 360. The processed imaging media proceeds to imaging media dryer 370 where it is dried and then into imaging media scanner 380 where the images are digitized and the digital images are transmitted to control computer 250.

It is to be understood that the present invention may be varied with out departing from the scope of the present invention, the present invention being defined by the claims set forth below.

PARTS LIST

10 Process apparatus
20 Lower processor section
25 Support projection
30 Upper processor section
32 Processing solution
35 Mating surface
40 External tank
42 Imaging media
50 Photosensitive media entrance
60 Processing apparatus channel
70 Solution overflow
80 Solution impingement slot nozzle
90 Photosensitive media exit
100 Integrated transport/solution squeegee roller set
102 Contacting roller
104 Contacting roller with drive gear
106 Collection section108 side wall
110 Solution drain
115 Imaging film/media
116 External tank conduits
120 Imaging film/media emulsion side
125 Imaging film/media back side
130 Drive gear
140 Solution management system
142 Conduits
150 Pump
160 Impulse "on demand" heater
170 Solenoid controlled valve
175 Solenoid controlled valve
180 Solenoid controlled valve
185 Solenoid controlled valve
190 Flapper valve
200 Solution filter
205 Pressure release valve
210 Solution storage tank
220 Solution effluent storage tank
225 Solution replenisher module
230 Solution metering pump
240 Replenisher storage tank
242 Replenishment solution
250 Control computer
260 Effluent tank solution return solenoid controlled solution valve
270 Integrated processing apparatus system 280 Imaging media loading station
290 APS film cartridge
300 Controlled drag loading rollers
310 Step 1
320 Step 2
330 Step 3
340 Step 4
350 Step 5
360 Processor section outer encasement
370 Imaging media dryer
380 Imaging media scanner

What is claimed is:

1. A processor for processing of photosensitive media, comprising:

a narrow processing channel for holding a processing solution;

at least one delivery opening for delivering said processing solution in an impinging manner against the photosensitive media to said narrow processing channel;

an outlet for allowing processing solution to be withdrawn from said narrow processing channel;

a recirculation system for delivering and circulating a predetermined batch amount of said processing solution through said narrow processing channel from said outlet to said at least one narrow delivery opening for processing a predetermined amount of photosensitive media passing through said narrow processing channel, said recirculation system having a conduit through which a processing solution flows and having said conduit having a heat conductive thin wall section in contact with a controlled heat source for heating of said processing solution to a first predetermined temperature; and an emptying system for removing said processing solution from said narrow processing channel and said recirculation system when said photosensitive media is not being processed through said narrow processing channel.

2. A processor according to claim 1 wherein said first predetermined temperature is equal to or greater than 115 degree F.

3. A processor according to claim 1 further comprising a cooling mechanism for cooling said processing solution.

4. A processor according to claim 3 wherein said predetermined amount of processing solution is cooled to a temperature equal to or about ambient temperature.

5. A processor according to claim 3 wherein said cooling mechanism comprises returning said predetermined amount of processing solution to a tank in said emptying system, said tank containing an amount of said processing solution substantially greater than said predetermined amount of processing solution so that it will be cooled down to a second predetermined temperature.

6. A processor according to claim 3 wherein the ratio of said amount of processing solution in said tank to said batch amount of processing solution is equal to or greater than an amount necessary for developing of predetermined amount of media.

7. A processor according to claim 6 wherein said predetermined amount of media comprises a roll of photographic film.

8. A processor according to claim 5 wherein said processing solution in said tank comprises a sufficient amount to develop a predetermined number of said predetermined amount of media.

9. A processor according to claim 8 wherein predetermined number of predetermined amount of media comprises a about 100 rolls of photographic film.

10. A processor according to claim 1 wherein said predetermined amount of photosensitive media comprises a single roll of photographic film.

11. A processor according to claim 1 further comprising a replenishment system.

12. A processor according to claim 1 wherein said narrow channel has a thickness no greater than about 0.25 inches.

13. A processor according to claim 1 wherein said narrow channel has a thickness no greater than about 0.125 inches.

14. A processor according to claim 1 wherein said narrow channel has a thickness equal to about 0.1 inches.

15. A method for processing a predetermined amount of photosensitive media in a processing apparatus having a narrow processing channel, at least one narrow delivery opening for delivering said processing solution in an impinging manner against said photosensitive media in said narrow processing channel, an outlet for allowing processing solution to be withdrawn from said narrow processing channel, and a recirculation system for recirculating said processing solution through said narrow channel from said outlet to said at least one narrow delivery opening, said recirculation system having a conduit through which a processing solution flows and having, said conduit having a heat conductive thin wall section in contact with a controlled heat source for heating of said processing solution to a first predetermined temperature comprising the steps of;

a. providing a predetermined batch amount of processing solution at an predetermined temperature by heating said processing solution in said conduit by said controlled heat source to said processing channel and said recirculation system;

b. maintains said predetermined amount of processing solution at an elevated predetermined temperature during processing of said photosensitive media;

c. removing said processing solution from said narrow processing channel and said recirculation system when no photosensitive media is being processed in said narrow processing channel.

16. A method according to claim 15 wherein said predetermined batch of processing solution is placed in a tank containing an amount of processing solution substantially greater than said predetermined batch amount of processing solution.

17. A method according to claim 15, further comprising the step of:

d. cooling said predetermined batch amount of processing solution when no photosensitive media is being processed.

18. A method for processing a predetermined amount of photosensitive media in a processing apparatus having a narrow processing channel, at least one narrow delivery opening for delivering processing solution in an impinging manner against said photosensitive media in said narrow processing channel, an outlet for allowing processing solution to be withdrawn from said narrow processing channel, and a recirculation system for recirculating a batch amount of through said narrow processing channel from said outlet to said at least one narrow delivery opening, said recirculation system having a conduit through which a processing solution flows and having, said conduit having a heat conductive thin wall section in contact with a controlled heat source for heating of said processing solution to a first predetermined temperature comprising the steps of:

a. providing said predetermined batch amount of processing solution at an predetermined temperature by heating said processing solution in said conduit by said controlled heat source to said processing channel and said recirculation system;

b. maintaining said predetermined amount of processing solution at an elevated predetermined temperature during processing of said photosensitive media;

c. cooling said predetermined amount of processing solution when no photosensitive media is being processed in said narrow processing channel.

19. A method according to claim 18 wherein said cooling is accomplished by removing said predetermined amount of processing solution from said recirculation system.

20. A method according to claim 19 wherein said predetermined batch amount of processing solution is placed in a tank containing a second amount of said processing solution substantially greater than said predetermined amount and having a temperature less than said predetermined amount of processing solution.

21. A method according to claim 19 wherein the removing of said processing solution from narrow processing channel and recirculation system when no photosensitive media present and delivering the solution to an effluent tank where it is no longer used for processing of photosensitive media.

* * * * *